United States Patent [19]

Hellström

[11] 4,093,007

[45] June 6, 1978

[54] METHOD FOR ROOT END CUTTING OF LUMBER AND A DEVICE FOR PERFORMING SAID METHOD

[75] Inventor: Nils Erik Hellström, Nyland, Sweden

[73] Assignee: AB Hammars Mekaniska Verkstad, Nyland, Sweden

[21] Appl. No.: 586,256

[22] Filed: Jun. 12, 1975

[30] Foreign Application Priority Data

Jul. 10, 1974 Sweden ..... 74090671

[51] Int. Cl.[2] ..... B27C 9/00; B27B 31/00

[52] U.S. Cl. ..... 144/326 R; 144/2 R; 144/242 D; 144/246 R; 144/312; 144/323

[58] Field of Search ..... 144/2 R, 242 R, 242 D, 144/242 E, 242 H, 245 R, 245 A, 245 D, 309 R, 312, 323, 326 R; 83/284, 365; 198/29, 105

[56] References Cited

U.S. PATENT DOCUMENTS

| | | | |
|---|---|---|---|
| 433,080 | 7/1890 | Heule et al. | 144/242 H |
| 2,403,673 | 7/1946 | Mead | 144/245 A |
| 2,876,815 | 3/1959 | Rogers | 144/326 R |
| 3,662,798 | 5/1972 | Campbell | 144/326 R |
| 3,756,297 | 9/1973 | Heikinheimo | 144/312 |
| 3,884,345 | 5/1975 | Tokuno | 198/35 |
| 3,885,483 | 5/1975 | Ikeya et al. | 83/365 |

*Primary Examiner*—Othell M. Simpson
*Assistant Examiner*—W. D. Bray
*Attorney, Agent, or Firm*—Silverman, Cass & Singer, Ltd.

[57] ABSTRACT

A root end cutting device for automatically aligning and cutting off the root ends of pieces of lumber. A conveying means transversely conveys the lumber through the device. Each piece of lumber is marked with a photosensitive transverse mark to indicate the location of a cut or with a longitudinal mark to indicate a second cut is not necessary. Each piece of lumber is then end cut by a first cutting blade. The pieces of lumber with a transverse mark are then aligned with a second cutting blade to make a second cut at the transverse mark.

3 Claims, 5 Drawing Figures

METHOD FOR ROOT END CUTTING OF LUMBER AND A DEVICE FOR PERFORMING SAID METHOD

The present invention relates to a method for root end cutting of lumber and also to a device for performing said method.

In known methods for root end cutting of lumber using transverse conveyor and a root end cutter blade the grader starts his work by judging where to locate the cut. Thereafter he has to pull each piece of lumber in the longitudinal direction by hand to the intended position at the root end cutter blade. Especially when thick lumber is cut, and with the continuously encreasing capacity requirements of today, this work is very hard and tiring.

It is an object of the present invention to provide a method and a device, by which the hard manual work can be highly reduced and also by which the capacity of the device can be raised.

The method according to the invention is characterized by the fact, that the grader, after inspection of the root end of a piece of lumber, either makes a transverse mark of phosphorescent, fluorescent or some other colour where the cut is to be made, said piece of lumber thereafter being transversely transported to a first root end cutter blade, by which end clean cuts are made, said piece of lumber thereafter being transversely fed with its root end surface guided by a fixed stop surface towards a first line of photo cells substantially perpendicular to the main transport direction, said photo cells giving an impulse to an electric device, by which lifting means are lowered, said lifting means being arranged to carry said piece of lumber, by which lowering the piece of lumber will come into contact with a transversely directed roller conveyor and be longitudinally fed thereby to an oblique transport plane, until the mark of the piece of lumber will be at a second line of photo cells located in the main transport direction, said photo cells giving an impulse to said selective device, by which the lifting means will lift the piece of lumber and thereby stop the longitudinal feeding thereof, said piece of lumber simultaneously being transversely transported to a second root end cutter blade, said mark passing said second root end cutter blade and the final root end cut thereafter being made or that the grader makes a mark at the root end of the piece of lumber in the longitudinal direction of said piece of lumber, said mark thereafter passing said firstmentioned line of photo cells after the piece of lumber has been end clean cut by said first root end cutter blade, the impulse from said photo cells to the electric device causing said lifting means to be lowered, so that the piece of lumber will be kept in contact with said stop surface, said mark of the piece of lumber thereafter arriving at said second line of photo cells, from which an impulse is given to said electric device, whereby said lifting means are swung up lifting the piece of lumber, before it is longitudinally displaced to be guided by the guiding surface, and thereafter the piece of lumber will be transversely transported past the second root end cutter blade without touching it.

A root end cutting device for performing said method using transport means, preferably endless chains and dogs thereon for transverse transport of the lumber through the whole device, is characterized by the fact, that it comprises in the transport direction in turn a single piece conveyor of a suitable, known construction, a driven, transversely directed roller conveyor and a fixed stop at the frontmost end of said roller conveyor in the driving direction for correct longitudinal location by the lumber root ends abutting against said stop, a part of the conveyor, in which the pieces of lumber are turned around their longitudinal axes and in which the root ends are manually graded, a first root end cutter blade for an end clean cut of each piece of lumber, a driven, additional, transversely directed roller conveyor, and, located at the frontmost end of said roller conveyor as seen in the driving direction, a first line of photo cells extending in the transverse direction of the device and a second line of photo cells extending in the longitudinal direction of the device and a light source cooperating therewith, and a transport plane located adjacent thereto, the distance between said transport surface and said second line of photo cells encreasing in the main transport direction of the lumber, said transport plane serving to guide the root ends of the lumber when this is transversely and longitudinally transported, and lifting means located between the rollers in the lastmentioned roller conveyor, said lifting means, by an impulse generated when a mark on a piece of lumber passes the first line of photo cells, being lowered under the supporting surfaces of the rollers so that the piece of lumber can be longitudinally displaced to a fixed stop surface, said lifting means by an impulse generated when said mark passes said second line of photo cells, being liftable over the supporting surface of the rollers to stop or prevent longitudinal displacement of the lumber by said roller conveyor, and a second root end cutter blade to cut the root ends of those pieces of lumber that are transversely transported to said root end cutter blade.

The method according to the invention will be explained below in connection with a description of a somewhat schematic embodiment of the invention shown in the attached drawings as an example.

Figure 1:
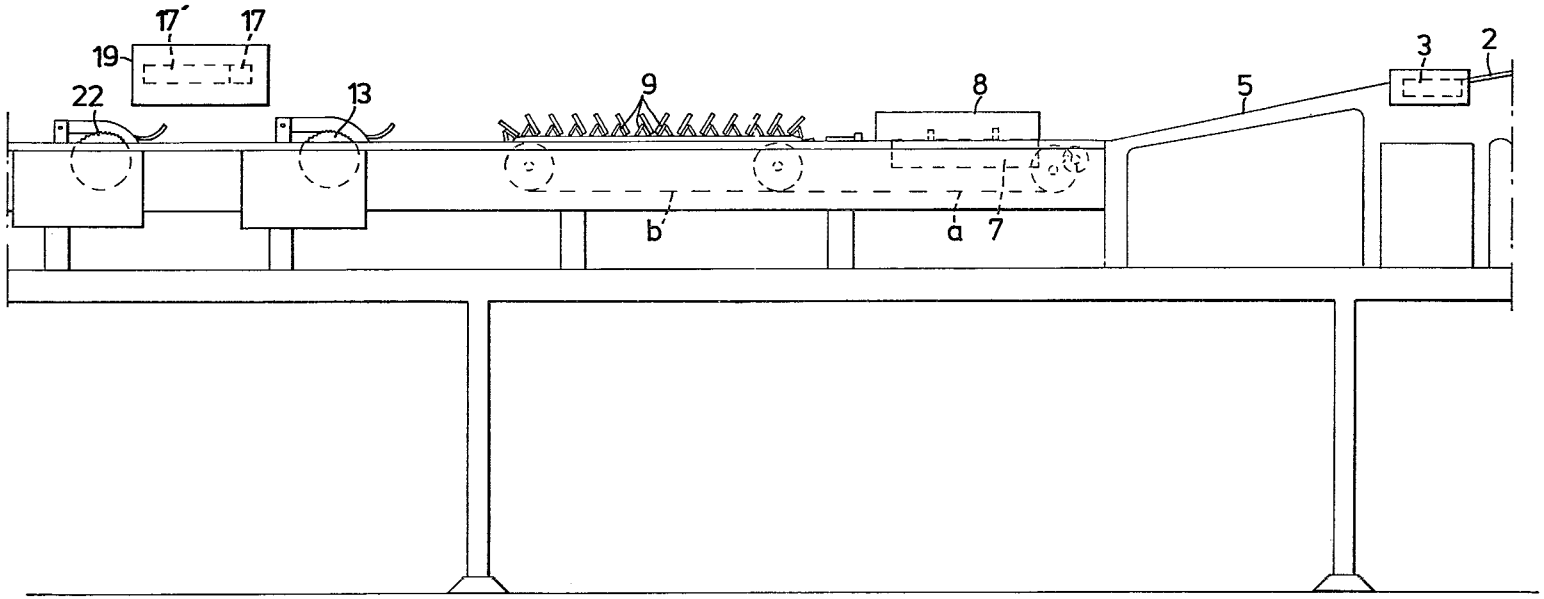
FIG. 1 is a side view of a root end cutting device according to the invention.
Figure 2:
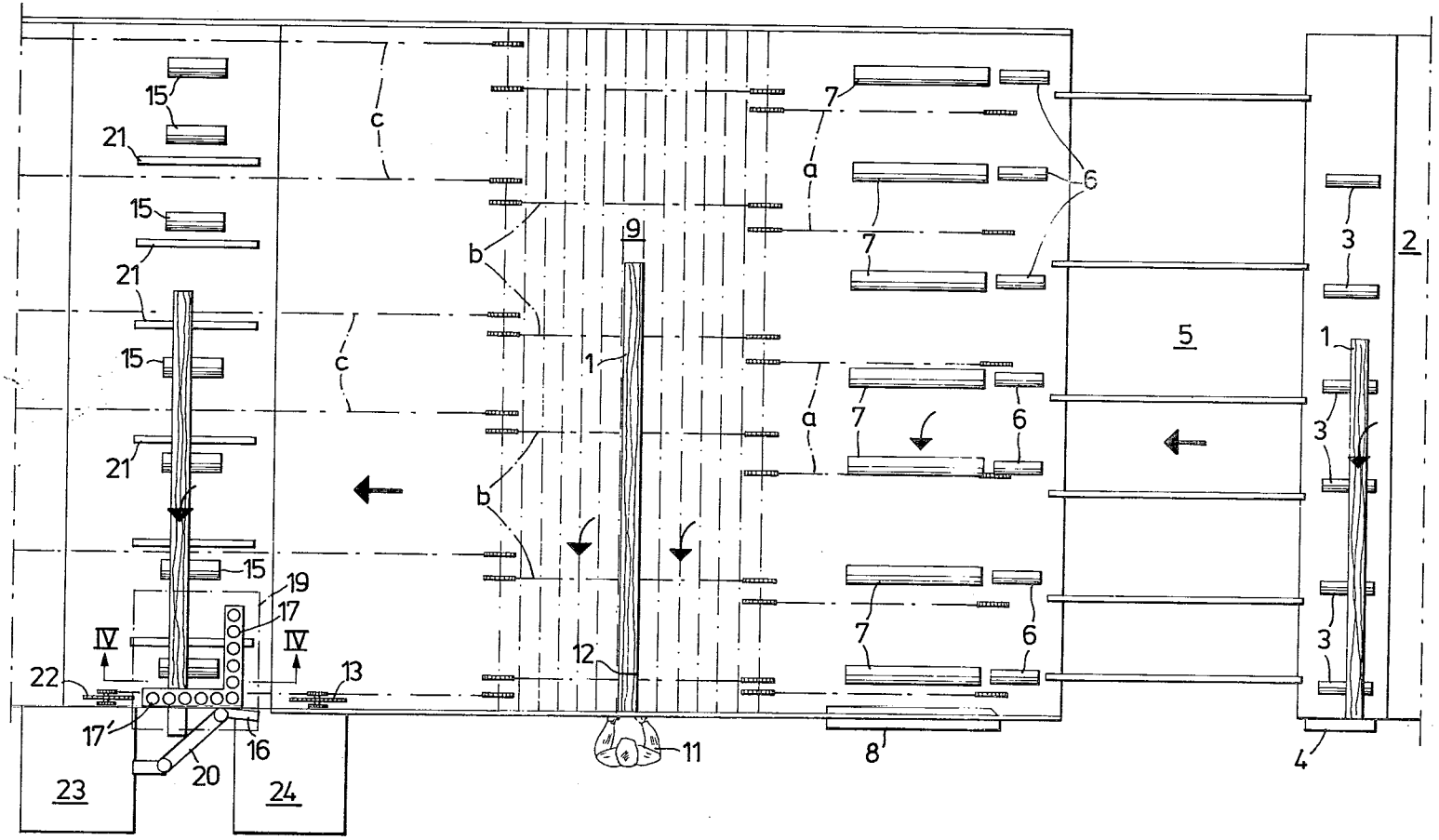
FIG. 2 is a view from above of said root end cutting device.
Figure 3:
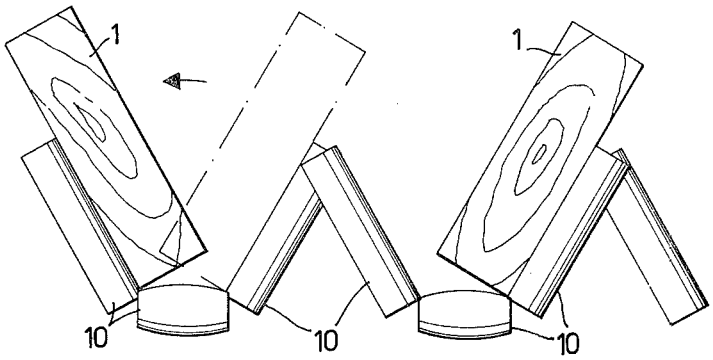
FIG. 3 is a side view on a larger scale of a part of the device.

The root end cutting device comprises known conveying means, preferably endless chains only shown by dash and dot lines *a,b,c* in FIG. 2. Said chains are provided with dogs (FIGS. 1 and 3) for transverse conveyance of the lumber through the whole device from the right to the left in FIGS. 1 and 2, as indicated by the arrows in the longitudinal direction of the device in FIG. 2. Said direction is below called the main transport direction of the device and is thus distinguished from transports in directions perpendicular thereto, which are indicated by small arrows. At the right end (the input end) of FIGS. 1 and 2 there is a lumber storage or the like not shown, where the pieces of lumber are so sorted that the root ends of all pieces are directed to the left as seen in the transport direction. From said storage or the like the lumber, which has the reference number 1 in all the figures, is transported by a transverse conveyor 2, to a roller conveyor consisting of driven rollers 3. Said roller conveyor will feed the pieces of lumber 1 in their longitudinal direction as shown by the arrow and thereby move their root ends to a first fixed stop 4 for a first longitudinal positioning of the pieces of lumber. Thereafter said pieces of lumber will be transported by a part 5 of the transverse conveyor to a single piece conveyor 6 of suitable construction. Thereafter the pieces of lumber will come to a further, broader transversely directed roller conveyor consisting of driven rollers 7, by which the pieces of lumber are longitudinally displaced at the same time as they are transversely transported. Thereby the root ends of the pieces of lumber are displaced to be guided by a second fixed stop 8, which is located substantially in line with said first stop 4. The pieces of lumber will thereafter come, one by one, to a conveyor 9, which comprises chains b and dogs arranged thereon, said dogs forming deep grooves, the bottoms and sides of which being formed by rollers 10, FIG. 3. The "dogs" are the spaced upstanding members on the transport chains which engage and move the pieces of lumber and the dogs could also be called lugs or grippers. One or several graders 11 are positioned at said conveyor 9 grading the passing pieces of lumber while tilting them manually. Said grader or graders also mark the pieces of lumber by drawing or stamping a transverse line 12 of phosphorescent or fluorescent or some other colour across the piece of lumber where a cut is to be made in order to remove parts of the root ends that are of inferior quality. If the part to be cut off is long, for example more than 600mm, the grader will pull the piece of lumber, which is easily displaceable on the rollers 10, towards himself, but not as much as 600mm, so that the line can be comfortably drawn. If the piece of lumber only is to be clean cut at the root end, which is always made by a fixed root end cutter blade 13 further described below, the grader will draw or stamp a line, dots or the like at the root end in the longitudinal direction of the piece of lumber.

Thus marked pieces 1 of lumber are transversely conveyed to the first root end cutter blade 13, the cutting plane of which lying preferably 10–20mm inside of the guiding plane of the other stop 8, whereby a piece of 10–20mm or longer is cut off, if the grader has pulled the piece of lumber towards himself.

The final cut is made with the guidance of the transverse mark 12 made by the grader with phosphorescent or fluorescent or some other colour. After the piece of lumber has been clean cut as described above by the cutter blade 13, the piece of lumber is transported to chains C, the dogs of which being spaced by 600mm, and to a transversely directed roller conveyor consisting of driven rollers 15. Before the piece of lumber has reached the roller conveyor 15, its end surface will come into abutment with an oblique stop 16. Thereby the piece of lumber will be located or aligned in the intended longitudinal position relative to a photo cell device schematically shown and located above the conveyor as shown in FIG. 1. Said photo cell device consists of a first line of photo cells 17 located substantially perpendicular to the main transport direction and a second line of photo cells 17' located in the same direction and preferably aligned with the cutter blade 13.

Figure 4:
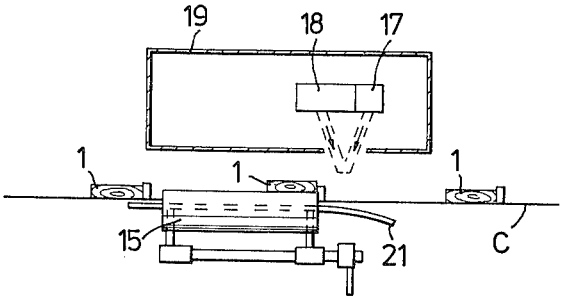
FIG. 4 is a section on a larger scale at the line IV—IV in FIG. 2.

At the side of each line of photo cells 17, 17' there is provided a suitable light source 18, see FIG. 4. The photo cells and the light sources are enclosed in a dark chamber 19 open downwards for the light rays.

Outside of and at the side of the second line of photo cells 17' the stop surface 16 continues in a transport or braking plane 20 formed by for example a vertical, endless belt on rollers. The distance between the transport plane 20 and the line of photo cells 17' is increasing (preferably 600mm as a maximum) in the maintransport direction. When the piece of lumber with a transverse marking line drawn or stamped on it is transversely fed to the line of photo cells 17 and the special lamp of the light source 18, an impulse is given, under influence of one or several photo cells 17 to an electric device not shown. By said electric device lifting means 21, which are located between the rollers 15 and extending above these, are lowered in response to said impulse, whereby the piece of lumber will sink down on the rollers 15, see also FIG. 5. At the same time as the piece of lumber is transversely transported a displacement of the piece of lumber in its longitudinal direction immediately starts, its end surface being guided by the transport plane 20. When the marking line passes the line of photo cells 17' an impulse is given therefrom to the electric device mentioned above, whereby said lifting means 21 will swing up lifting the piece of lumber from the rollers 15 so that the longitudinal displacement of the piece of lumber will immediately cease, but the transport in the main transport direction (in the transverse direction of the piece of lumber) by the conveyor chains will continue. The lumber is continuing at all times to be transversely conveyed by the different sets of chains, *a, b* and *c*. The piece of lumber thereby suitably located or aligned in the longitudinal direction will now be fed to a fixed second root end cutter blade 22, the cutting plane of which being substantially aligned with the line of photo cells 17'. Hereby the piece of lumber will be cut off at the transverse marking line or close thereto depending on the position of the second root end cutter blade 22 in relation to the line of photo cells.

If, however, the piece of lumber from its end is provided with a longitudinal line or mark or the like, this will cause said impulse from the photo cells 17 to the electric device to produce a lowering of said lifting means 21 as before. However, the rollers 15 can not displace the piece of lumber longitudinally more than that its end surface will come against the stop 16, see FIG. 5. When the mark comes to the first photo cell 17', the lifting means 21 will be swung up lifting the piece of lumber from the roller conveyor 15, the piece of lumber possibly making a simultaneous small return movement. The lifting of the piece of lumber stops the longitudinal displacement so that the lumber end surface will not come into contact with the transport plane 20 and the piece of lumber will have such a longitudinal position, that it will pass the second root end cutter blade 22 without any contact therewith and without any cut being made. Again, the lumber is continuing at all times to be transversely conveyed to the different sets of chains *a, b* and *c*. Each piece of lumber with a longitudinal mark on it will be sensed by the second line of photo cells 17' and the lifting means 21 will be raised so that the piece of lumber cannot be further longitudinally displaced by the rollers 15.

Figure 5:
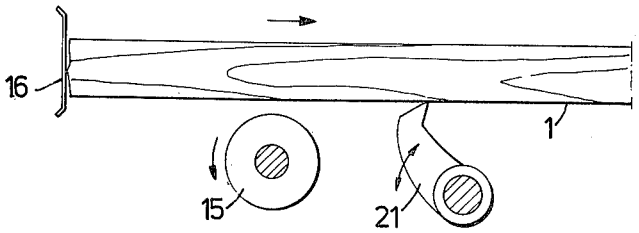
FIG. 5 shows on a larger scale and schematically a detail of the device.

The operation of the rollers 15 and the lifting means 21 can clearly be seen in FIGS. 4 and 5. As previously mentioned, when the lifting means 21 is down the rollers will longitudinally displace the piece of lumber, but when the longitudinal mark is sensed by the photo cell 17' the lifting means 21 will raise as shown in FIG. 5 so the lumber is no longer in contact with the rollers 15. The lumber; however, at no time becomes displaced from the dogs which can be seen following the pieces of lumber in FIG. 4, but are not numbered.

Therefore, when a piece of lumber has a longitudinal mark on it, it will pass by the second fixed cutter 22 without a second cut being made. When the piece of lumber has a transverse mark on it; however, it will be displaced until this transverse mark is sensed by the photo cells 17'. As more clearly seen in FIG. 2 it is displaced longitudinally by the rollers 15 against the braking plane 20 until the transverse mark is sensed. When the transverse mark is sensed the longitudinal movement is again stopped by the lifting means 21 lifting the piece of lumber from the rollers 15, and the end is then cut off very close to the transverse mark as the piece of lumber is moved passed the fixed second root cutter 22 by the dogs on the set of chains *c*.

After the piece of lumber has thus passed the second root end cutter blade 22 it will be conveyed into a part of the device, in which the required top end cut can be made in a known way.

At each cutter blade 13, 22 there is a collecting device 23, 24 for collecting and transporting away the ends cut off from the pieces of lumber.

It is a special advantage of the method and device according to the invention that the grader can indicate the exact location of a root end cut. Hereby the cut off piece will be the shortest possible, which is economically as well as otherwise advantageous, as the quantity of lumber passing the device is very high. The grader does no longer have to pull each piece of lumber longitudinally to the right position for the root end cut, which work was very hard and fatiguing, especially when lumber of great dimensions was handled and the capacity requirements were high. By the method and the device according to the invention the grader will only have to pull longitudinally just for example every sixth or every seventh piece of lumber and putting a mark on all the pieces of lumber. Hereby the manual, fatiguing work is reduced by 80-85%. In addition to this the total capacity of the device can be increased, and especially if there are two or more graders, so that each grader will only have to grade every other piece of lumber.

The method and the device according to the invention can of course be modified within the scope of the invention. For example the marks can be made with a reflecting colour or with various kinds of coatable or in some other way applicable agents that are suitable for the generation of impulses.

What we claim is:

1. A root end cutting device for cutting ends of pieces of lumber, each piece having a longitudinal or transverse mark, said device having spaced first and second ends and comprising:

conveying means for transversely conveying the pieces of lumber through the device;

a stop;

first means for moving said pieces of lumber against said stop;

first cutter means for making a first end cut on each piece of lumber as the same is being conveyed through said device;

second cutter means longitudinally spaced from said first cutter means;

sensing means for sensing said marks;

means responsive to sensing a transverse mark for longitudinally moving said pieces to align said transverse mark with said second root cutting means for making a second cut substantially at said transverse mark; and means for stopping said longitudinal movement with said mark and said second cutter in alignment.

2. A device as claimed in claim 1 wherein:

said first moving means include a single piece conveyor and a first roller conveyor driven transversely to said conveying means;

said marks are photosensitive marks;

said sensing means include a first elongate photosensing means aligned transverse to said device for generating a first signal when said marks pass by said first photosensing means; inclined limiting means longitudinally spaced from said stop;

said longitudinally moving means including a second roller conveyor driven transversely to said conveying means for moving said pieces of lumber against said inclined limiting means;

said sensing means also including a second elongate photosensing means aligned parallel to said device for generating a second signal when said transverse marks pass by said second photosensing means; and said means for stopping including lifting means for lifting said pieces of lumber from said second roller conveyor in response to said second signal, said lifting means being lowered in response to said first signal.

3. A method for cutting the ends of pieces of lumber, each piece having a longitudinal or a transverse mark, said method comprising the steps of:

transversely conveying the pieces of lumber;

moving said pieces of lumber longitudinally against a first stop;

making a first end cut on said pieces of lumber as the same are being conveyed;

sensing said marks;

longitudinally moving said pieces of lumber against an inclined stop in response to sensing a transverse mark;

aligning said transverse mark with a second root cutting means;

stopping said longitudinal movement with said transverse mark aligned with said second cutting means; and making a second cut substantially at said transverse mark.

* * * * *